United States Patent [19]

Frohock, Jr.

[11] Patent Number: 4,787,291

[45] Date of Patent: Nov. 29, 1988

[54] GUN FIRE CONTROL SYSTEM

[75] Inventor: Millard M. Frohock, Jr., Encino, Calif.

[73] Assignee: Hughes Aircraft Company, Los Angeles, Calif.

[21] Appl. No.: 914,213

[22] Filed: Oct. 2, 1986

[51] Int. Cl.[4] ..... F41G 3/06; F41G 3/08

[52] U.S. Cl. ..... 89/41.22; 89/41.17; 89/41.06; 235/404

[58] Field of Search ..... 89/41.06, 41.19, 41.22, 89/41.17, 41.03, 41.05; 235/404

[56] References Cited

U.S. PATENT DOCUMENTS

| | | | |
|---|---|---|---|
| 2,570,298 | 10/1951 | Wheeler | 89/41.17 |
| 3,575,085 | 4/1971 | McAdam, Jr. | 89/41.06 |
| 3,766,826 | 10/1973 | Salomonsson | 89/41.19 |
| 3,840,794 | 10/1974 | Clement et al. | 89/41.19 |
| 4,004,729 | 1/1977 | Rawicz et al. | 89/41.22 |
| 4,011,789 | 3/1977 | Bresee, Jr. et al. | 235/404 |
| 4,146,780 | 3/1979 | Sprey | 89/41.22 |
| 4,494,198 | 1/1985 | Smith et al. | 235/404 |

FOREIGN PATENT DOCUMENTS

| | | | |
|---|---|---|---|
| 1571811 | 7/1980 | United Kingdom | 89/41.03 |
| 2107833 | 5/1983 | United Kingdom | 89/41.22 |

*Primary Examiner*—Charles T. Jordan
*Assistant Examiner*—Stephen Johnson
*Attorney, Agent, or Firm*—Lewis B. Sternfels; A. W. Karambelas

[57] ABSTRACT

A fire control system (10) for a gun (12) pivotally mounted in elevation and in azimuth employs optical sighting of a target (16) manually via a telescope (26) fixedly directed substantially parallel to an axis of the gun (12). A laser range finder (24) directs its laser beam in a direction parallel to the telescope (26) to obtain target range. The system includes a control unit (42) which employs elevation, azimuth and range data to predict target track. The control unit (42) includes electric circuitry for offsetting the gun to provide for an intercept of the target by a projectile fired from the gun, and delay circuitry which delays a firing of the gun until the gun has been offset. Gun orientation is directed manually during tracking of the target, and passes to automatic control in response to a firing command.

9 Claims, 2 Drawing Sheets

GUN FIRE CONTROL SYSTEM

BACKGROUND OF THE INVENTION

This invention relates to gun fire control systems and, more particularly, to a computerized control system for aiding a gunner, while providing simplified construction in that a telescopic sight and laser range finder are fixedly secured in alignment with the gun barrel or other launcher of projectiles.

During the firing of a projectile from a gun, the direction of travel of the projectile differs from the direction in which the gun is pointed due to the forces of gravity, air resistance and wind. Therefore, the gunner must sight on a target along a line called a sight line which differs from a line, known as a gun line, along which the gun points. In the case wherein a target trajectory would carry the target across the gun line, the gun must be oriented such that the gun line leads the target and points ahead of the sight line to allow for the time of flight of the projectile. Thus, there is an angular divergence between the gun line and the sight line.

The angular divergence has a component in the elevation plane and a second component in a lateral or azimuthal direction normal to the elevation plane. The amount of angular divergence in elevation and azimuth depend on target range, the speed of relative motion of the target with respect to the gun, as well as on other factors including gravity, air resistance and wind.

Due to the divergence between gun line and sight line, the gun and the sight normally require separate two-axis positioning systems and separate two-axis position sensing system which entail costly hardware and increase the complexity of such gun fire control systems.

In most gun fire control systems, the angular divergence between sight line and gun line is produced by a servomechanism positioning a reticle in a sight or a mirror in a periscope. A problem exists in that such construction increases cost and complexity of equipment.

SUMMARY OF THE INVENTION

The foregoing problem is overcome and other advantages are provided by a fire control system for a launcher of projectiles, particularly a gun, wherein the axis of the telescopic sight is locked in orientation relative to the axis of the gun barrel. The sight line and the gun line are parallel and may be regarded as a combined gun/sight line. Thus, there is only one set of elevation and azimuthal drives, and one set of elevation and azimuthal sensors. In the frequently encountered case wherein the gun is stabilized, rate gyroscopes used in gun stabilization systems may be employed as elevation and lateral sensors to control the position of gun line and sight line.

In the operation of the control system of the invention, a gunner uses the combined gun/sight line to aim the gun/sight line at the target. A laser range finder connected to the gun is advantageously employed by the gunner to determine target range and, during a tracking of the target, the rate gyroscope enables the gunner to determine angular rate of the gun/sight line. Included within the system of the invention is a computer which operates in response to signals from the gyroscopes and the laser range finder to determine required angular divergence between the present sight line and the direction of the gun line when the gun is to be fired. Data regarding air resistance and wind speed is also applied to the computer for use in the computations of projected angular divergence.

When the target is at a range suitable for interception by the projectile, and has been within the sighting reticle as viewed by the gunner along the sight line for a sufficient interval, the gunner then presses the trigger to fire the gun. The system of the invention inhibits the gun from firing for an interval of approximately one second. During this interval, the controller commands the gun to move by the required computer angular divergence between the present sight line and the future gun line at the time of firing. During this interval, the gunner need not see the target in the telescopic sight, nor does the laser range finder provide target range. When the gun reaches equilibrium in the requisite firing position, the firing inhibit is removed and the gun fires.

Thereby, the gun/sight line performs double duty; it is used as a sight line until the gunner presses the fire button. Once the gunner has thus committed himself, the gun/sight line becomes the gun line.

BRIEF DESCRIPTION OF THE DRAWING

The foregoing aspects and other features of the invention are explained in the following description, taken in connection with the accompanying drawing wherein.

DETAILED DESCRIPTION

Figure 1:
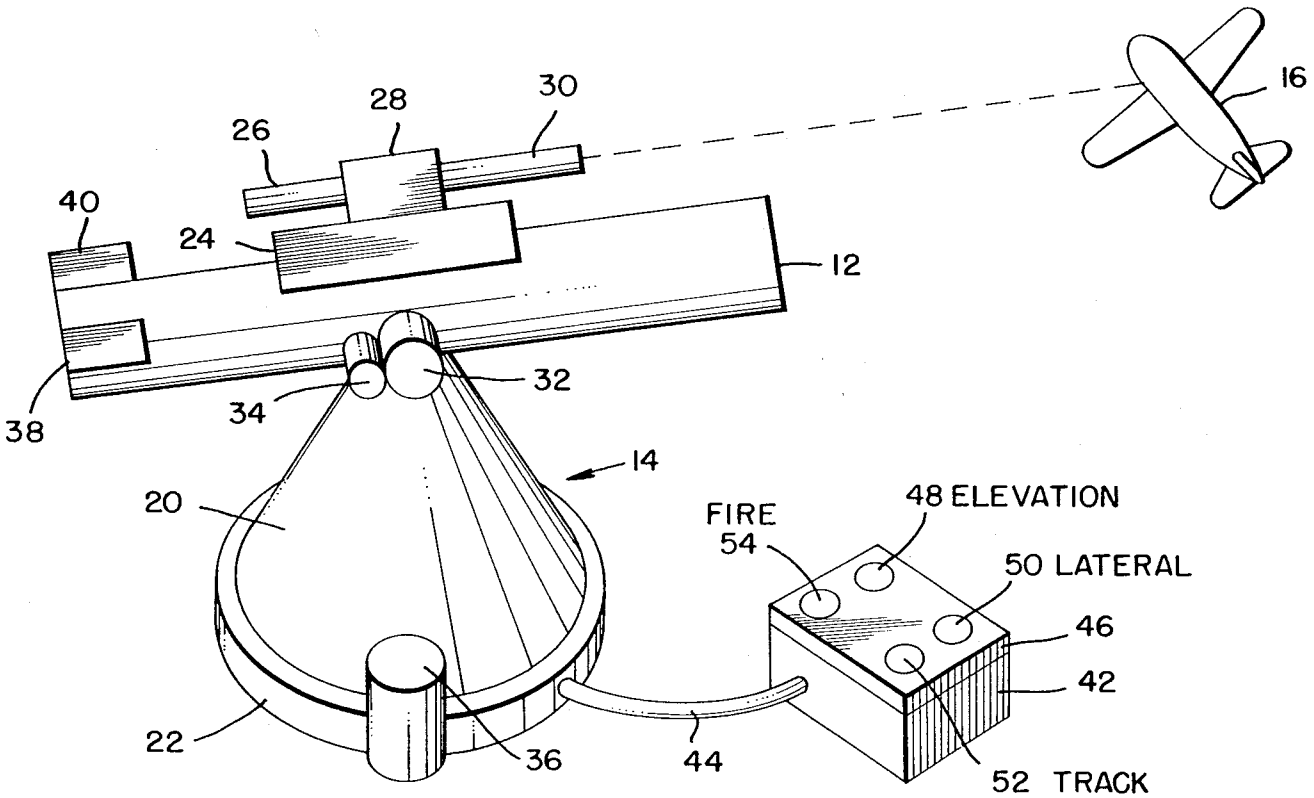
FIG. 1 is a stylized view of a gun fire control system of the invention.

With reference to FIG. 1, a gun fire control system 10, of the form known as a directed gun system, is constructed in accordance with the invention and includes a gun 12 supported by a mount 14 for shooting at a target 16, which target may be an aircraft by way of example. The system 10 may be located on a fixed platform or carried by a vehicle (not shown). The mount 14 comprises a support 20 and a base 22. The gun 12 is pivotable in elevation about the support 20, the support 20 being rotatably mounted to the base 22 for orienting the gun in azimuth.

The system 10 includes a laser range finder 24 which provides range of the target 16 from the mount 14, and a telescope 26 which provides elevation and azimuth coordinates of the target 16 relative to the gun line. The telescope 26 and the range finder 24 may be coupled by an optical coupling 28 to share a common optical section 30 of the telescope 26 or, alternatively, the range finder 24 may have a separate output optical section (not shown) mounted alongside and parallel to the telescope 26.

The gun 12 is pivoted in elevation by a motor 32 to an elevation angle measured by an angle sensor 34, both the motor 32 and the sensor 34 being positioned at the top of the support 20. The sensor 34 outputs the secant of the elevation angle of the gun 12 relative to the support 20. The gun 12 and the support 20 are rotated in azimuth by a motor 36 about the base 22, the motor 36 being positioned on the base 22 alongside the support 20. Rate gyroscopes (also referred to as gyros) 38 and 40 are secured to the barrel of the gun 12 for sensing changes in angular orientation of the gun 12. The gyro 38 senses rotation about an axis of elevation. The gyro 40 senses rotation about a lateral axis, which axis is perpendicular to the elevation axis and to a longitudinal axis of the gun 12. Rotation of the gun 12 about an azimuthal axis is related to rotation about the lateral axis by the secant of the elevation angle, the secant being provided by the elevation sensor 34, as noted above. Electric drive signals to the motors 32 and 36 are provided by an electronic gun control unit 42 in response to electric signals from the gyros 38 and 40, as will be described with reference to FIG. 2, both the motor signals and the gyro signals being coupled between the mount 14 and the control unit 42 by a cable 44.

Manual operator controls to the system 10 are provided by a control panel 46 which may be positioned on the control unit 42 and has a set of knobs 48, 50, 52 and 54 thereon. Knobs 48 and 50 are rotatable for inputting signals to the control unit 42 to designate, respectively, desired elevation and lateral angle rates to the gun 12 whereupon the control unit 42 activates the motors 32 and 36 for rotating the gun 12 at the commanded angular velocities. Knob 52 signals the control unit 42 that the sightline is tracking the target 16. Knob 54 signals the control unit 42 to fire the gun 12. These control functions of the panel 46 will be described further with reference to FIG. 2.

The theory of the invention is applicable for gun positioning servos, including position and rate controlled servos, as well as for fire control systems of the types known as "director", "disturbed", and "directed gun". For the tracking of moving targets, the system of the invention estimates two angular rates normal to the sight line, commonly referred to as omega-e (elevation) and omega-l (lateral).

In accordance with a feature of the invention, the orientation of the telescope 26 is locked to the orientation of the gun 12. This may be accomplished in either of two ways. The telescope 26, the coupling 28 and the range finder 24 may all be rigidly secured to the gun 12, by way of example, by construction of the telescope 26 and the range finder 24 as an integral assembly secured to the gun 12 as shown in FIG. 1. Alternatively, the telescope 26 and the range finder 24 may be mounted separately from the gun 12, and slaved thereto by a servomechanism (not shown). The latter arrangement is advantageous for isolating the telescope from shock associated with a firing of the gun, while the former arrangement (shown in FIG. 1) is advantageous for its mechanical simplicity.

By the locking of the telescope 26 to the gun 12, the operation of the system 10 differs from that of a conventional fire control system (not shown) in that during the directing of the gun 12 to shoot at the target 16, the telescope 26 may lose sight of the target 16. As is well known, the directing of the gun 12 involves a superelevation angle wherein the gun 12 points above a sight line to the target 16 so as to compensate for a projectile trajectory wherein the projectile drops due to the force of gravity. In addition, to shoot a target moving across boresight, a lead angle is applied to the gun orientation whereby the gun shoots ahead of the target to allow time for the projectile to reach the target. During the presence of the superelevation and the lead angles, the gun 12 with the telescope 26 fixed thereto point above and ahead of the target 16. Hence, during the firing of the gun 12, the target 16 is not aligned with a reticle of the telescope 26 and may even be outside its field of view.

The invention takes advantage of the fact that the amount of time required to offset a gun from the line of sight, preparatory to the firing of a projectile, is sufficiently small, at least in relation to the time of flight of a typical projectile, that target sighting can be omitted during the offsetting of the gun. Accordingly, as will be explained with reference to FIG. 2, an operator of the gun 12 pushes the knob 52 to signal that he has begun target tracking by manually training the telescope 26 on the target 16. After the control unit 42 has tracked the target 16 sufficiently to enable prediction of future target track, the operator pushes the knob 54 to request the control unit 42 to fire the gun 12. Thereupon, the control unit 42 disconnects the manual elevation and lateral control knobs 48 and 50, stores the predicted target track while disregarding any further information from the knobs 48 and 50, offsets the gun 12 for delivery of the projectile, and fires the gun 12. Thereupon, the gun offset is removed and the manual controls are returned so that the operator can view again the target 16, and manually train the telescope 26 and the gun 12.

Figure 2:
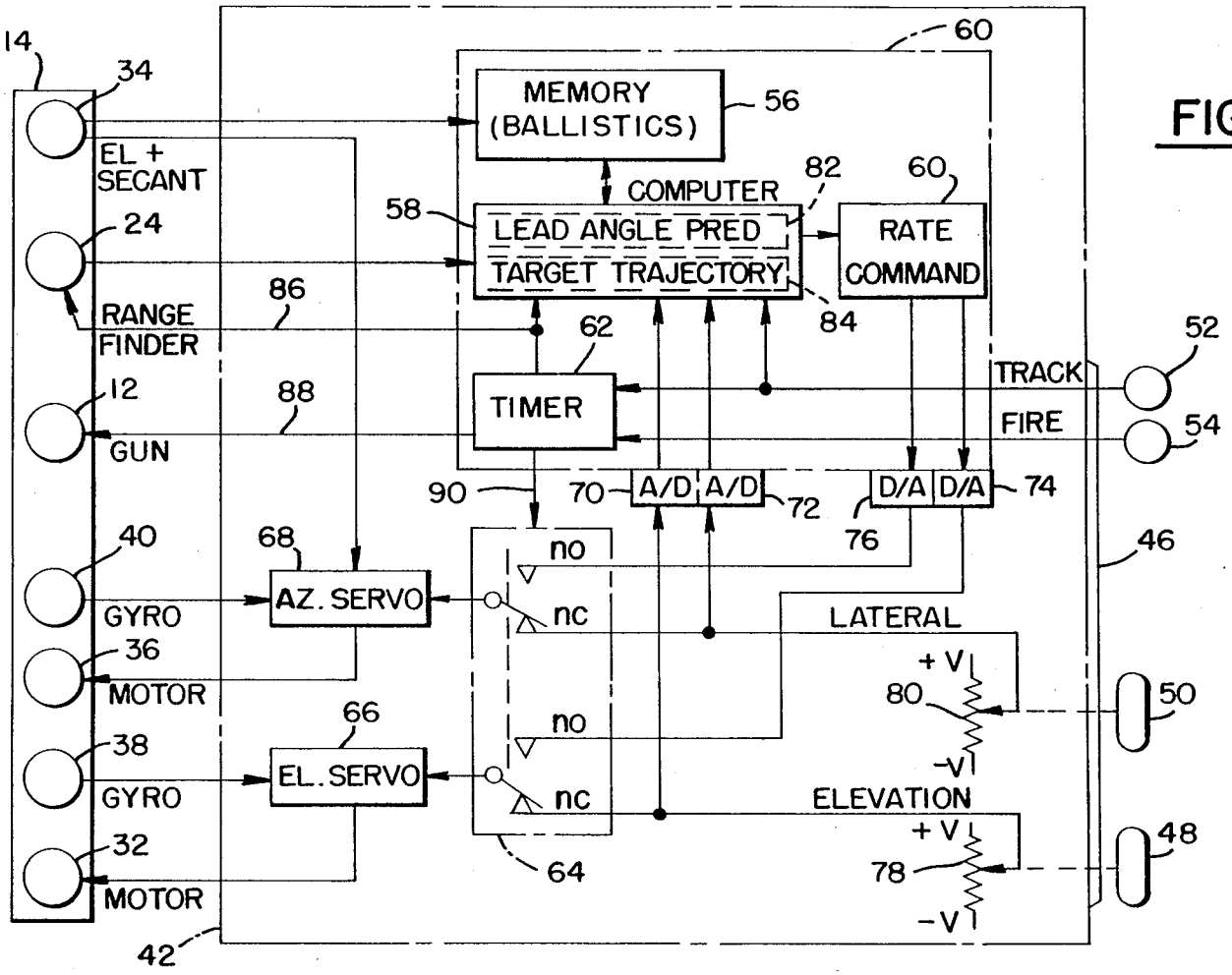
FIG. 2 is a block diagram of a controller for a gun of FIG. 1.

With reference also to FIG. 2, there are shown the components of the control unit 42 and the interconnections of these components to the components of the gun mount 14 of FIG. 1. The control unit 42 comprises a memory 56, a digital fire-control computer 58, a rate command unit 60, a timer 62, a switch 64, a servomechanism drive 66 for driving the elevation motor 32, a servomechanism drive 68 for driving the azimuth motor 36, two analog-to-digital converters 70 and 72, two digital-to-analog converters 74 and 76, and two potentiometers 78 and 80. The potentiometers 78 and 80 are mechanically coupled to the elevation and the lateral input knobs, respectively, and are electrically connected between a source of voltage (+V and −V) for outputting electric signals to the computer 58 and to the elevation and azimuthal drives 66 and 68. The elevation and lateral potentiometer signals are converted from analog to digital format by the converters 70 and 72, respectively, for used by the computer 58. The potentiometer signals are coupled via the switch 64 to the drives 66 and 68.

The computer 58 comprises circuitry for performing well-known target tracking tasks, calculation of projectile trajectories, and intercept points between target tracks and projectile trajectories. These computer functions are indicated by functional blocks designated as a lead-angle predictor section 82 and a target trajectory section 84. The trajectory section 84 operates in a well-known fashion to predict the target trajectory based on inputted data of target range from the range finder 24, and target direction data inputted by the elevation and the lateral knobs 48 and 50. The lead-angle section 82 operates in a well-know fashion to compute the requisite elevation and azimuthal coordinate angles of the gun 12 to eject a projectile to strike the target 16.

The operation of the trajectory section 84 is based on projectile ballistic data provided by the memory 56. The memory 56 stores ballistic data for the projectile to be fired by the gun 12, which data describes the trajectory of the projectile as a function of range and elevation angle. The memory 56 is addressed by the elevation signal outputted by the sensor 34. The requisite elevation and azimuthal angular coordinates for firing the gun 12 lead the present angular coordinates of the target sight line in the direction of travel of the target 16. Output signals of the lead-angle section 82 are applied to the rate-command unit 60 which operates in a well-known fashion to provide servo drive signals for repositioning the gun 12 with the necessary lead angles (elevation and azimuth). Output signals of the rate-command unit are converted from digital to analog format by the converters 74 and 76, and are coupled via the switch 64 to the elevation and azimuthal servo drives 66 and 68, respectively.

The servo drive 66 receives an elevation rate signal outputted by the gyro 38. The servo drive 68 receives a lateral rate signal outputted by the gyro 40, and the secant of the elevation angle outputted by the sensor 34. The servo drive 66 forms the difference between the actual gun elevation rate and the commanded elevation rate. The lateral rate signal provided by the gyro 40 is multiplied by the secant of the elevation angle at the servo drive 68 to form the difference between the actual gun azimuth rate and the commanded azimuth rate. The difference signals are employed, in accordance with well-known servomechanism theory in produce motor drive signals applied, respectively, to the motors 32 and 36. Thereby, the motors 32 and 36 position the gun 12 in accordance with either manually inputted commands from the knobs 48 and 50 or automatically inputted orientation offset signals supplied by the computer 58.

During an actual combat situation, the operational procedure in use of the gun 12 is as follows. The operator sights the target 16 through the telescope 26, and employs the knobs 48 and 50 for training the telescope 26 on the target 16. The range finder 24 is also operated to transmit laser signals which reflect back from the target 16 in a well-known fashion to provide target range. As the operator visually and manually tracks the target 16, the angle measurement sensor 34, the gyros 38 and 40, and the range finder 24 output target coordinate data to the control unit 42 for use by the computer 58 in recording present value of target track and in predicting future target track.

The target tracking function of the computer 58 is initiated by a pressing of the knob 52. The knob 52 is coupled to the computer 58 to initiate trajectory and lead angle calculations, and is also coupled to the range finder 24 via line 86 and the timer 62 for strobing the range finder 24 to output target range data to the computer 58. The operator pushes the knob 52 when good manual tracking is attained, and thereby insures that only good data is inputted into the computer tracking task. In the computer 58, the trajectory section 84 computes the trajectory of the target baed on angular velocities of the gun 12 and range data from the range finder 24. Also, in the computer 58, the lead-angle section 82 computes possible intercept points based on projected projectile trajectory and target track to output orientation offset signals to the servo drives 66 and 68 for offsetting the gun.

After the good track has been obtained, based on the operator's judgement as to smooth movement of the gun 12, the operator pushes the knob 54 to command a firing of the gun 12. The knob 54 connects with the timer 62. In response to the fire command, the timer 62 initiates a firing interval, and at the conclusion of the firing interval, outputs a signal on line 88 to fire the gun 12. The firing interval has a typical duration of approximately one-half to one second. The delay of the firing interval is sufficient to allow the gun 12 to be offset from the sight line to provide the superelevation and lateral lead angles for firing the projectile at the target 16.

In accordance with a feature of the invention, during the firing interval, the timer 62 inhibits the signal on line 86 to disable the range finder 24 during the firing interval, thereby to freeze the range input to the computer 58 during such time as the gun 12 and the range finder 24 which is rigidly secured to the gun 12 are offset from the sight line. During the firing interval, the timer 62 also outputs a signal on line 90 to operate the switch 64 to terminate manual control of gun position, and to initiate automatic control of gun position by the computer 58.

Operation of the switch 64 disconnects the servo drives 66 and 68 from their respective potentiometers 78 and 80, and reconnects the servo drives 66 and 68 to the computer output via the converters 74 and 76. The computer 58 then outputs the requisite elevation and azimuth angles in the form of time varying angular rates to the servo drives 66 and 68 in accordance with the computed target trajectory and projectile ballistics. The drives 66 and 68 activate the motors 32 and 36 to offset the gun 12, after which the timer 62 transmits the fire command to the gun 12 via line 88 to launch the projectile. After the projectile, or a sequence of projectiles has been fired by the gun 12, the timer 62 resets the switch 64 to remove the offset from the gun position so that the target is again in the field of view of the telescope 26.

With respect to the construction of the range finder 24 and the telescope 26, suitable forms of range finder and telescope already exist. One such device, known as the GVS-5, is adequate for a ground vehicle target, and combines a monocular viewing system with a laser rangefinder in a hand held unit having a structure similar to a binocular. For anti-aircraft purposes, other well-known equipment is employed for measuring range at higher sampling rates or for measuring range rate as is required for tracking of moving aircraft. In such devices, generally, the laser receiving optics and the viewing telescope objective are combined, as by use of a beam splitter near the focal plane. In some constructions, the laser transmitter also uses an objective in common with the viewing telescope. In the later configuration, a shutter is generally required in the eyepiece to protect a viewed from backscatter of the laser beam off of the objective lens. If desired, the shutter may be employed in the preferred embodiment of the invention during the firing interval, when the gun is being skewed away from the sight line to firing position, to shield the operator (gunner) from viewing a sudden scene change.

By way of alternative embodiments, it is noted that an eyepiece of the telescope may be replaced with a television vidicon and a remote viewing screen such as a CRT (cathode ray tube). Such a configuration of the gun control system is suitable for use with an automatic tracking system which senses the deviation of the target image from the reticle and generates the appropriate electrical commands to the servo drives. It is also noted that, while the system of the invention has been described with reference to the use of a telescope, a directed gun system may also be constructed by use of a tracking radar, in lieu of the telescope, for viewing the target and for obtaining target range.

It is appreciated that the foregoing system aids a gunner in shooting a target with improved accuracy provided by the computerized tracking of a target. The gunner loses sight of the target in the telescope for a relatively short period of time only during the firing of the gun. The system is advantageous because of its simplified construction.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A gun fire control system for directing a launcher of a projectile at a target, comprising:

means for commanding a firing of said projectile;

means for directing said launcher towards said target, said launcher being pivotally supported about a first axis and a second axis;

gyro means locked to said launcher for providing rate signals designating rates of rotation of said launcher about said first axis and said second axis;

motor means for positioning said launcher;

optical sighting and ranging means having an orientation locked to an orientation of said launcher for outputting target coordinate signals; and wherein said directing means includes predicting means responsive to the target coordinate signals of said sighting and ranging means for predicting a future track of said target, and offsetting means responsive to a firing command of said commanding means for offsetting said launcher relative to a sight line to said target for interception of said target by a projectile fired from said launcher;

said offsetting means develops further rate signals combined with said rate signals of said gyro means for driving said motor means during an offsetting of said launcher; and said directing means includes means responsive to the firing command of said commanding means for disconnecting said sighting means and ranging means from said predicting means during an offsetting of said launcher, said offsetting being based on target track obtained prior to the firing command.

2. A system according to claim 1 wherein operation of said predicting means is based on sightings of the target by said sighting and ranging means prior to a firing command signal of said commanding means.

3. A system according to claim 1 wherein said launcher is a gun, and said optical sighting and ranging means are physically connected to said gun to provide said locked orientation.

4. A system according to claim 1 wherein said launcher is a gun, and said directing means includes means for delaying a firing of said gun until after the offsetting of said gun.

5. A system according to claim 1 further comprising means for manually designating an orientation of said launcher, said motor means being responsive to said designating means for positioning said launcher; and wherein said directing means includes means responsive to a firing command of said commanding means for switching said motor means to said offsetting means from said manual designating means, thereby to permit automatic positioning of said launcher preparatory to firing said projectile.

6. A system according to claim 5 wherein said directing means further comprises means for delaying a firing of said gun until after the offsetting of said gun; and said gyro means includes an elevation gyro providing rotation rate about said first axis and a lateral gyro providing rotation rate about second axis, said first axis and said second axis being, respectively, elevation and lateral axes.

7. A system according to claim 6 wherein said optical sighting and ranging means comprises a telescope manually operative for providing elevation and azimuth angular coordinates of the target, and a laser range finder for providing target range.

8. A system according to claim 7 wherein said offsetting means includes a memory for storing ballistic data for a projectile to be fired by said gun, and means coupled to said memory and employing said ballistic data for predicting projectile trajectory to an intercept point with a target.

9. A system according to claim 1 wherein said offsetting means includes a memory for storing ballistic data for a projectile to be fired by said launcher, and means coupled to said memory and employing said ballistic data for predicting projectile trajectory to an intercept point with a target.

* * * * *